US006109551A

United States Patent [19]

Sullivan

[11] Patent Number: 6,109,551

[45] **Date of Patent: *Aug. 29, 2000**

[54] CUTTER APPARATUS FOR WASTE DISPOSAL UNIT

[75] Inventor: Donald J. Sullivan, Sandwich, Ill.

[73] Assignee: Environmental Systems & Solutions, Inc., Draper, Utah

[ * ] Notice: This patent issued on a continued prosecution application filed under 37 CFR 1.53(d), and is subject to the twenty year patent term provisions of 35 U.S.C. 154(a)(2).

[21] Appl. No.: 09/150,132

[22] Filed: Sep. 9, 1998

[51] Int. Cl.[7] ..... B02C 18/16

[52] U.S. Cl. ..... 241/46.013; 241/88; 241/261

[58] Field of Search ..... 241/46.013, 46.014, 241/46.015, 46.016, 46.06, 85, 88, 92, 261, 261.3

[56] References Cited

U.S. PATENT DOCUMENTS

| | | | |
|---|---|---|---|
| 1,456,034 | 5/1923 | Newman | 241/243 |
| 2,012,680 | 8/1935 | Hammes | 241/46.013 |
| 2,862,536 | 12/1958 | Gronberg | 241/243 |
| 2,870,970 | 1/1959 | Williamson | 241/46.013 |
| 3,700,178 | 10/1972 | Verley . | |
| 3,940,115 | 2/1976 | Zipperer | 241/261 |
| 4,082,229 | 4/1978 | Boosman . | |
| 4,168,035 | 9/1979 | Palm et al. | 241/243 |
| 4,720,050 | 1/1988 | Eberhardt | 241/243 |

*Primary Examiner*—Mark Rosenbaum
*Attorney, Agent, or Firm*—Thorpe, North & Western, LLP

[57] ABSTRACT

A waste disposal apparatus has a cutter apparatus with angled teeth. The cutters may be disposed in a passage of a housing having an inlet and an outlet. The cutter apparatus has a stationary cutter and a pivoting cutter which pivots with respect to the stationary cutter. The stationary cutter has a plurality of teeth intermeshing with a plurality of teeth on the secondary cutter as the secondary cutter pivots. The teeth of the stationary and pivoting cutters have edges that extend towards one another at an angle with respect to a traverse direction perpendicular to a longitudinal axis such that the teeth meet at an angle. Each edge has a leading edge which meets first to concentrate cutting force at a point along the edge. The force moves along the edge from the leading edge to a trailing edge. A drive means rotates the pivoting cutter. The waste disposal apparatus may be a water powered waste disposal apparatus. The drive means may have a housing defining an annular chamber with a drive piston slidingly disposed therein and coupled to the pivoting cutter.

18 Claims, 5 Drawing Sheets

CUTTER APPARATUS FOR WASTE DISPOSAL UNIT

BACKGROUND OF THE INVENTION

1. The Field of the Invention

The present invention relates generally to cutters with angled edges for a waste disposal unit, and more specifically to a waste disposal apparatus with cutters having angled edges.

2. The Background Art

Waste disposal units disposed under sinks have become commonplace. The waste disposal unit cuts or shreds waste, such as table scraps, so that the waste may pass through pipes of a house plumbing system without clogging the pipes. The disposal units provide the convenience of simply washing waste directly into the sink without having to first wipe the waste into a trash receptacle or having to later clear the waste from a drain in the sink. Disposal units are typically mounted under the sink between the drain in the bottom of the sink and the pipes of the plumbing system and typically have cutters disposed in the units and coupled to electric motors to cut the waste as it passes through the units. A plurality of cutters are typically associated together in a stack with stationary and rotating cutters in an alternating configuration. The cutters typically have radiating arms with openings formed therebetween, or have openings formed in plates, for waste to pass through. The cutters typically have intermeshing teeth formed on the arms, or on the plates about the openings. As the waste passes through the openings in the cutters, the arms and the teeth thereon shred or cut the waste.

Despite the conveniences provided by these waste disposal units, there are several disadvantages, one of which is the configuration or shape of the cutters or teeth. The cutters or teeth often meet with blunt or straight edges or faces. Because of the blade configuration, waste is more likely to become lodged in between cutters and jam the unit. In addition, the unit requires a large motor to develop sufficient torque to cut the waste with the blunt configuration of the cutters. Thus, the units may be inefficient because they require an oversized motor.

Another disadvantage is the need for electrical wiring to operate the motor. Because of this, the devices are difficult to install and pose a danger of coupling an electric source to the water and plumbing system. Another disadvantage is the low starting torque of the electric motors. Waste initially disposed in the unit may stall the motor. Thus, the motor may burn out or pose a danger of injury as a user reaches into the unit to remove the clogged waste.

One attempt in the art to overcome the foregoing disadvantages of electric motors is provided in U.S. Pat. No. 3,700,178, issued Oct. 24, 1972, to Verley, and U.S. Pat. No. 4,082,229, issued Apr. 4, 1978, to Boosman, which disclose water powered waste disposal units. The units have a housing defining an annular chamber around the unit. A reciprocating drive piston is slidingly disposed in the chamber and is coupled to a pivoting cutter in the housing. A valve alternately directs pressurized water into the annular chamber on opposite sides of the drive piston to drive the piston, and thus the cutter, in a reciprocal rotating motion.

Despite advantages presented by the above-described water powered waste disposal units, they still suffer from the disadvantage of cutters with blunt configurations.

Therefore, it would be advantageous to develop a cutter apparatus for use with waste disposal units capable of effectively cutting waste. It would also be advantageous to develop such a cutter apparatus for use with water powered waste disposal units. It would also be advantageous to develop a disposal apparatus with cutters capable of effectively and efficiently cutting waste.

OBJECTS AND SUMMARY OF THE INVENTION

It is therefore an object of the present invention to provide a cutter apparatus for use with a waste disposal unit for effectively cutting waste.

It is another object of the present invention to provide such a cutter apparatus for use with a water powered waste disposal unit.

It is another object of the present invention to provide a waste disposal unit with cutters for effectively and efficiently cutting waste.

The above objects and others not specifically recited are realized in a specific illustrative embodiment of a cutting apparatus having a primary cutter and a secondary cutter. At least one of either the primary or secondary cutters rotates with respect to the other cutter, defining relative rotation. The primary cutter has a primary hub defining a longitudinal axis and a plurality of primary arms extending radially from the primary hub generally perpendicular to the longitudinal axis. The secondary cutter is disposed adjacent the primary cutter on the longitudinal axis. The secondary cutter has a secondary hub and a plurality of secondary arms extending radially from the secondary hub generally perpendicular to the longitudinal axis.

A plurality of staggered or spaced apart primary teeth are disposed or formed on the primary cutter. The primary teeth define primary spaces therebetween.

A plurality of staggered or spaced apart secondary teeth are disposed or formed on the secondary cutter. The secondary teeth define secondary spaces therebetween. The primary and secondary teeth intermesh during relative rotation with the primary teeth extending into the secondary spaces and the secondary teeth extending into the primary spaces. The primary teeth extend generally towards the secondary cutter. The secondary teeth extend generally towards the primary cutter.

At least one primary tooth and at least one secondary tooth, adjacent the primary tooth during relative rotation, each have an edge extending towards one another during relative rotation. The edges extend at an angle to a traverse direction. The traverse direction is perpendicular to the longitudinal axis and the arms.

In accordance with one aspect of the present invention, the edge of the at least one primary tooth is oriented at an obtuse angle with respect to the primary arm. Similarly, the edge of the at least one secondary tooth is oriented at an acute angle with respect to the secondary arm. The edges preferably are oriented to form an angle therebetween of approximately 14 degrees.

In accordance with another aspect of the present invention, the at least one primary tooth has an opposite edge opposite the primary edge. Similarly, the at least one secondary tooth has an opposite secondary edge opposite the secondary edge. Each opposite edge extends at an angle to the traverse direction. Thus, the cutters may operate to cut waste with a cutter rotating in either direction.

In accordance with another aspect of the present invention, the apparatus has a housing. The housing has an inlet, an outlet, and a passage extending therebetween. The primary cutter and the secondary cutter are disposed in the passage and oriented with the longitudinal axis parallel with the passage.

In accordance with another aspect of the present invention, the cutting apparatus may have a plurality of cutters arranged in a stack.

In accordance with another aspect of the present invention, a waste disposal apparatus has a housing. The housing has a waste inlet, an outlet, and a passage extending therebetween. The passage has a longitudinal axis. The plurality of cutters are disposed in the passage of the housing for cutting the waste. The cutters include at least one pivoting cutter pivotally disposed in the passage and at least one stationary cutter fixedly disposed in the passage adjacent the pivoting cutter. The stationary cutter is similar to the primary cutter and the pivoting cutter is similar to the secondary cutter as described above.

In accordance with another aspect of the present invention, the apparatus has a drive means for rotating at least one of either the primary or secondary cutters. The drive means may be an electric motor or a hydraulic motor.

The drive means may comprise a drive housing having an annular chamber and a reciprocal drive piston slidably disposed in the annular chamber and coupled to at least one of the primary or secondary cutters.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
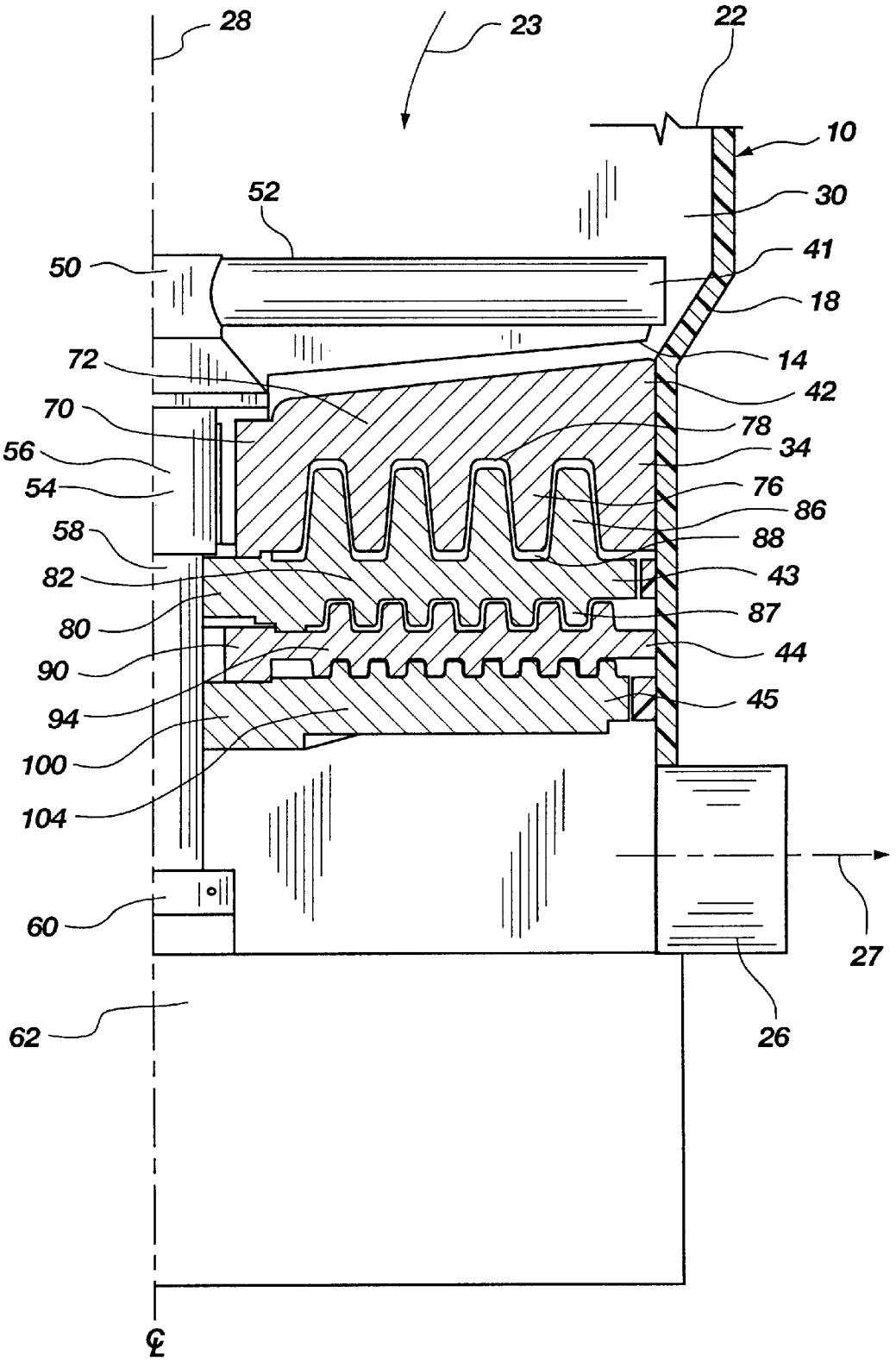
FIG. 1 is a partial cross sectional side view a waste disposal apparatus with a cutter apparatus in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Referring to FIG. 1, a waste disposal apparatus, indicated generally at 10, with a cutter apparatus, indicated generally at 14, is shown. The waste disposal apparatus 10 has an apparatus housing 18 adapted for being disposed under a sink (not shown). The housing has a first end and a second end. The first end may be the top of the housing while the second end may be the bottom of the housing. The housing 18 has a waste inlet 22 disposed at the first end for allowing the waste into the housing 18, indicated by arrow 23. The housing 18 and/or inlet 22 may be configured for being coupled to a drain (not shown) of a sink (not shown). The housing 18 also has an outlet 26 disposed at the second end for allowing the waste out of the housing 18, indicated by arrow 27. The outlet 26 may be configured for being coupled to a plumbing system (not shown).

Figure 6:
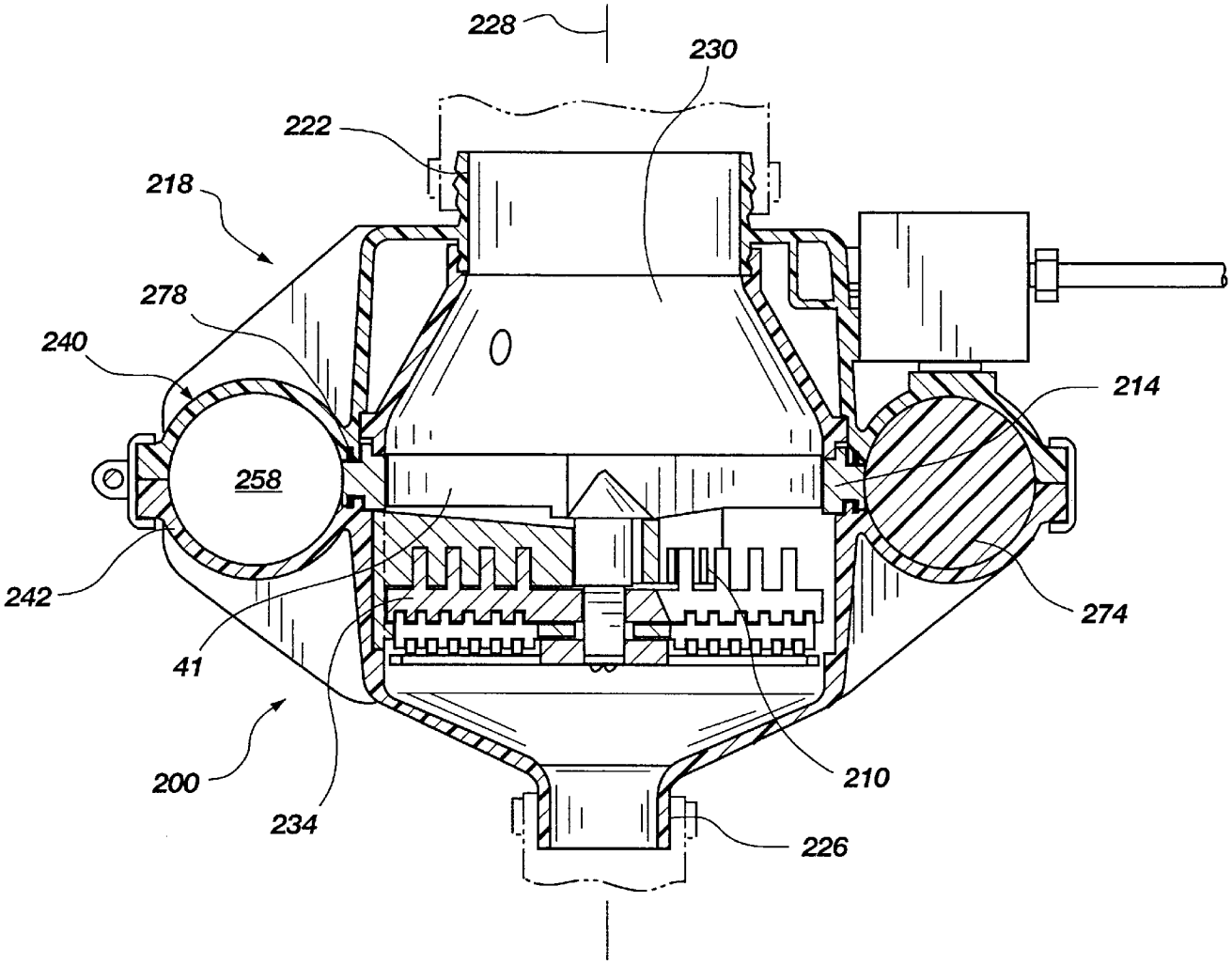
FIG. 6 is a cross sectional side view of a water powered waste disposal apparatus with a cutter apparatus in accordance with the principles of the present invention.

The housing 18 also defines a waste passage 30 formed in the housing 18 and extending between the waste inlet 22 and the outlet 26. The passage 30 may have a longitudinal axis 28 extending between the first and second ends of the housing. The longitudinal axis may extend between the inlet 22 and outlet 26 as shown in FIG. 6. The housing 18 may also have a longitudinal axis which is concentric with the longitudinal axis 28 of the passage 30. The passage 30 may have a circular cross section.

Figure 2:
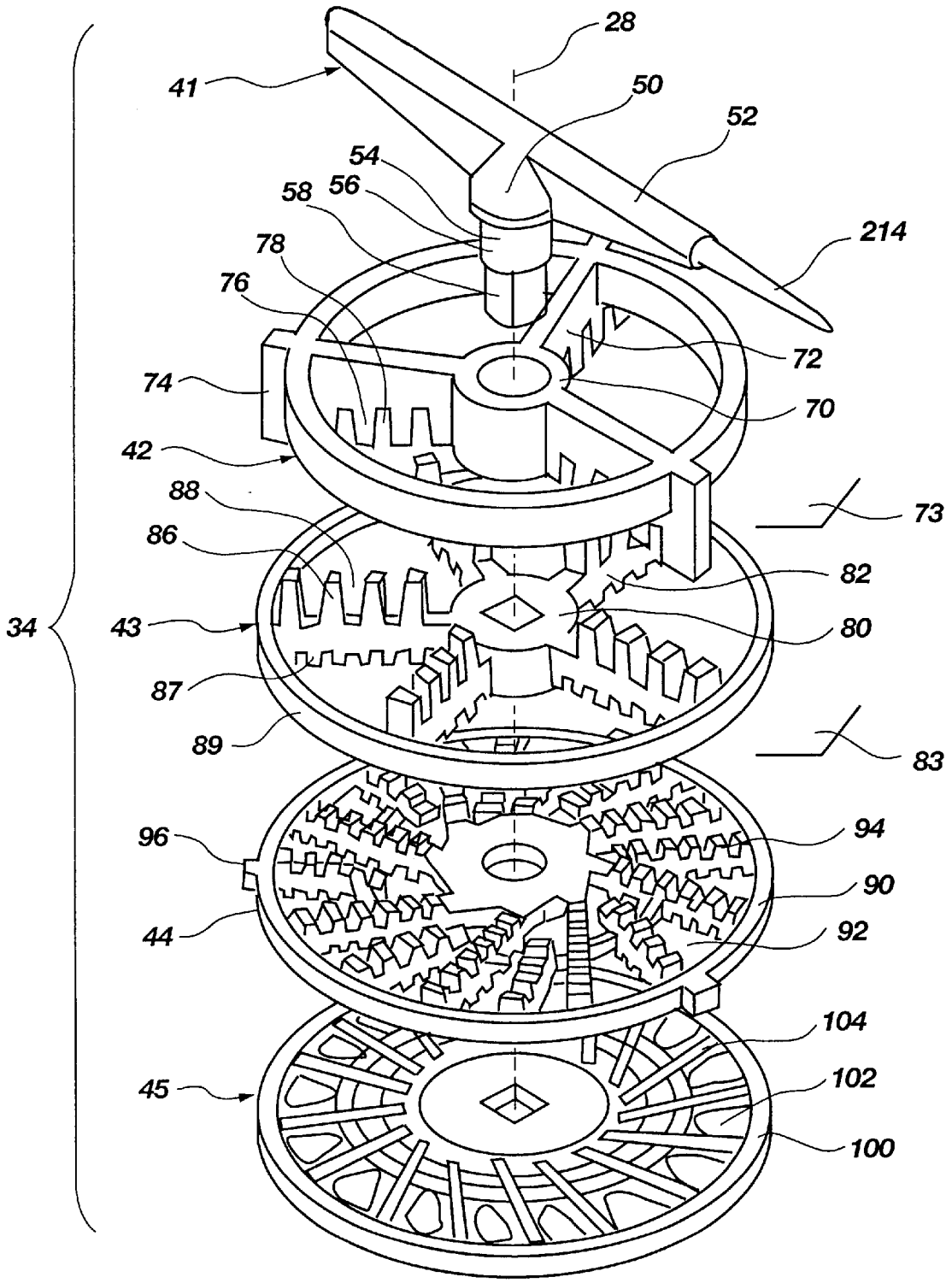
FIG. 2 is an exploded view of the cutter apparatus in accordance with the principles of the present invention.

A plurality of cutters 34 are disposed in the passage 30 for cutting or shredding the waste as the waste passes through the passage 30. The cutters 34 may be associated together in layers, or stacks. Referring to FIGS. 1 and 2, the cutters 34 may include a plurality of cutters with different configurations. As shown, the plurality of cutters 34 may include a first cutter 41, a second cutter 42 (or primary or stationary cutter), a third cutter 43 (or secondary or pivoting cutter), a fourth cutter 44, and a fifth cutter 45. It is of course understood that any number of cutters could be employed and that the above five cutters are exemplary only.

The first cutter 41 has first hub 50 disposed at the longitudinal axis 28 and a first arm 52 extending radially from the hub 50, or generally perpendicularly to the axis 28. The first cutter 41 is pivotally disposed in the passage 30, as shown in FIG. 1. The first arm 52 may be configured for engaging a driver as discussed more fully below. The first cutter 41 may have a shaft 54 extending from the first hub 50 along the longitudinal axis 28. The shaft 54 may have circular portions 56, or bearing portions, and square portions 58, or key portions. The shaft 54 has a first end fixedly coupled to the first hub 50 and a second end 60 fixedly coupled to a motor 62.

The motor 62 rotates the shaft 54, and thus the first cutter 41. The motor is one example of a drive means for rotating the cutters. Other drive means may be used, including for example an electric motor, a hydraulic motor, etc.

Figure 3:
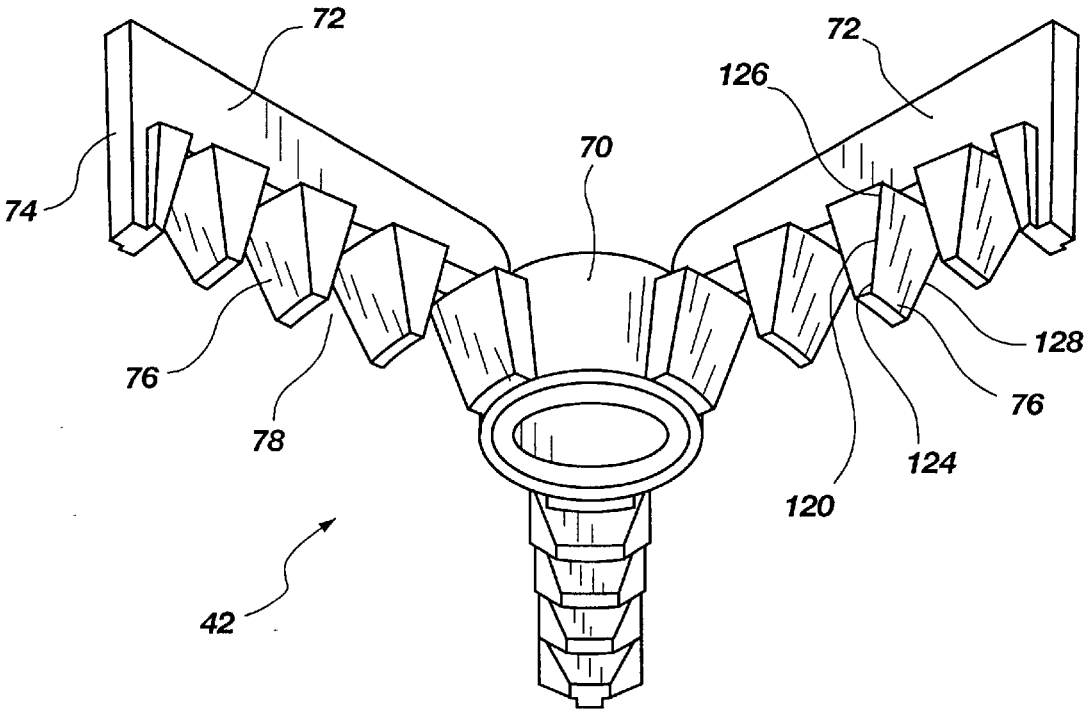
FIG. 3 is a perspective view of a primary stationary cutter of the cutter apparatus in accordance with the principles of the present invention.

Referring to FIGS. 1–3, the second cutter 42 is also referred to herein as the primary cutter or stationary cutter. The primary cutter 42 is disposed adjacent the first cutter 41 and has a primary hub 70, or stationary hub, disposed at the longitudinal axis 28. The primary hub 70 may define the longitudinal axis 28. The primary cutter 42 has a plurality of primary arms 72, or stationary arms, extending radially from the hub 70, or generally perpendicularly to the axis 28. The primary arms 72 define a primary plane 73 along which the arms extend, or a primary layer in which the arms extend, which is perpendicular to the longitudinal axis 28 as shown in FIG. 3. The primary cutter 42 is fixedly disposed in the passage 30, or is stationary, and has a tab 74 for engaging a notch (not shown) formed in the passage 30 to prevent the primary cutter 42 from rotating, as shown in FIG. 1. The primary hub 70 of the primary cutter 42 has a primary bore therein through which the shaft 54 passes. The primary bore is circular and receives a circular portion 56 of the shaft 54 so that the shaft 54 may rotate freely with respect to the primary hub 70. As the first cutter 41 rotates with respect to the primary cutter 42, the first arm 52 passes adjacent the plurality of primary arms 72, cutting waste therebetween.

A plurality of primary teeth 76 are disposed or formed on the primary arms 72. The primary teeth 76 are spaced apart or staggered along the primary arms 72. The primary teeth 76 extend from the arms 72 towards the third or secondary cutter 43. The primary teeth 76 define primary spaces or grooves 78 therebetween.

Figure 4:
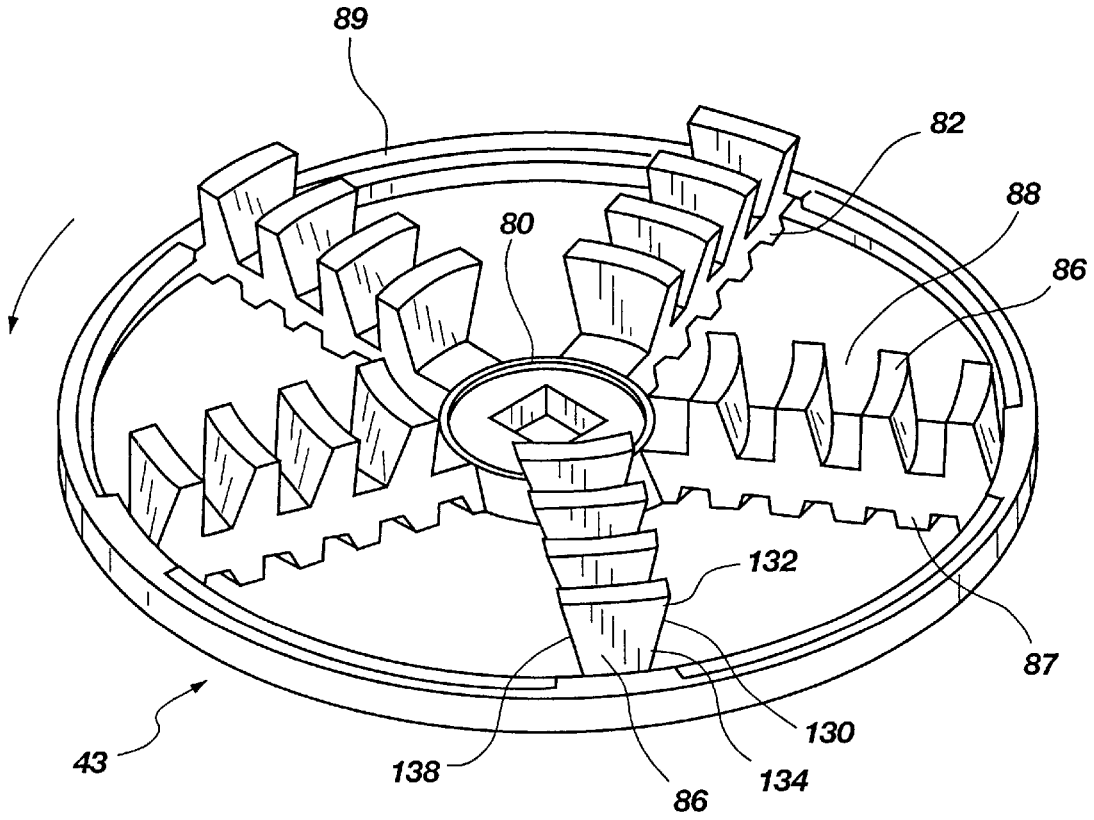
FIG. 4 is a perspective view of a secondary pivoting cutter of the cutter apparatus in accordance with the principles of the present invention.

Referring to FIGS. 1, 2 and 4, the third cutter 43 is also referred to herein as the secondary cutter or pivoting cutter. The secondary cutter 43 is disposed adjacent the primary cutter 42 and has a secondary hub 80, or pivoting hub, disposed at the longitudinal axis 28. The secondary cutter 43 has a plurality of secondary arms 82, or pivoting arms, extending radially from the hub 80, or generally perpendicularly to the axis 28. The secondary arms 82 define a secondary plane 83 along which the arms extend, or a secondary layer in which the arms extend, which is perpendicular to the longitudinal axis 28 and parallel with the primary plane 73, as shown in FIG. 3. The secondary cutter 43 is pivotally or rotatably disposed in the passage 30, as shown in FIG. 1.

The secondary hub 80 of the secondary cutter 43 has a secondary bore therein through which the shaft 54 passes. The secondary bore is square and receives a square portion 58 of the shaft 54 so that the secondary hub 80 rotates with the shaft 54. Thus, the first cutter 41 and secondary cutter 43 rotate with respect to the primary cutter 42. It is of course understood that the shaft 54 and secondary cutter 43 may be coupled or keyed in any suitable manner.

A plurality of secondary teeth 86 are disposed or formed on the secondary arms 82. The secondary teeth 86 are spaced apart or staggered along the secondary arms 82. The secondary teeth 86 extend from the arms 82 towards the second or primary cutter 42. The secondary cutter 43 may also have a plurality of teeth 87 extending away from the primary cutter 42. The secondary teeth 86 define secondary spaces or grooves 88 therebetween.

The primary and secondary teeth 76 and 86 intermesh as the secondary cutter 43 rotates with respect to the primary cutter 42, defining relative rotation between the two cutters 42 and 43. The primary teeth 76 extend into the secondary spaces 88. The secondary teeth 86 extend into the primary spaces 78. As the secondary cutter 43 pivots, waste is cut between the primary and secondary teeth 76 and 86, and between the primary and secondary arms 72 and 82. The waste passes between the plurality of primary arms 72 and between the plurality of secondary arms 82 where it is cut as the secondary teeth 86 pass by the primary teeth 76.

The secondary cutter 43 may have an annular support member 89 formed around the periphery of the cutter to support the secondary arms 82. The secondary arms 82 extend from the hub 80 to the support member 89.

Referring to FIGS. 1 and 2, the fourth cutter 44 is disposed adjacent the secondary cutter 43, or third cutter. The fourth cutter 44 may have a circular plate 90 with a plurality of openings 92 formed therein through which the waste may pass, as shown in FIG. 2. The openings 92 may be defined by arms 94 formed in the plate 90. The fourth cutter 44 is fixedly disposed in the passage 30, or is stationary, and has a tab 96 for engaging a notch (not shown) formed in the passage 30 to prevent the fourth cutter 44 from rotating, as shown in FIG. 1. A plurality of teeth are formed on the fourth cutter 44, or on the arms 94.

The plate 90 may have a bore therein through which the shaft 54 passes. The bore is circular and receives a circular portion 56 of the shaft 54 so that the shaft 54 may rotate freely with respect to the plate.

The fifth cutter 45 is disposed adjacent the fourth cutter 44. Like the fourth cutter 44, the fifth cutter 45 may have a circular plate 100 with a plurality of openings 102 formed therein through which the waste may pass, as shown in FIG. 2. The openings 102 may be defined by arms 104 formed in the plate 100. A plurality of cutters are disposed on the fifth cutter 45, or on the arms 104.

The fifth cutter 45 has a bore therein through which the shaft 54 passes. The bore is square and receives a square portion 58 of the shaft 54 so that the fifth cutter 45 rotates with the shaft 54. Thus, the first cutter 41, secondary cutter 43, and fifth cutter 45 rotate with respect to the primary cutter 42 and the fourth cutter 44.

Figure 5:
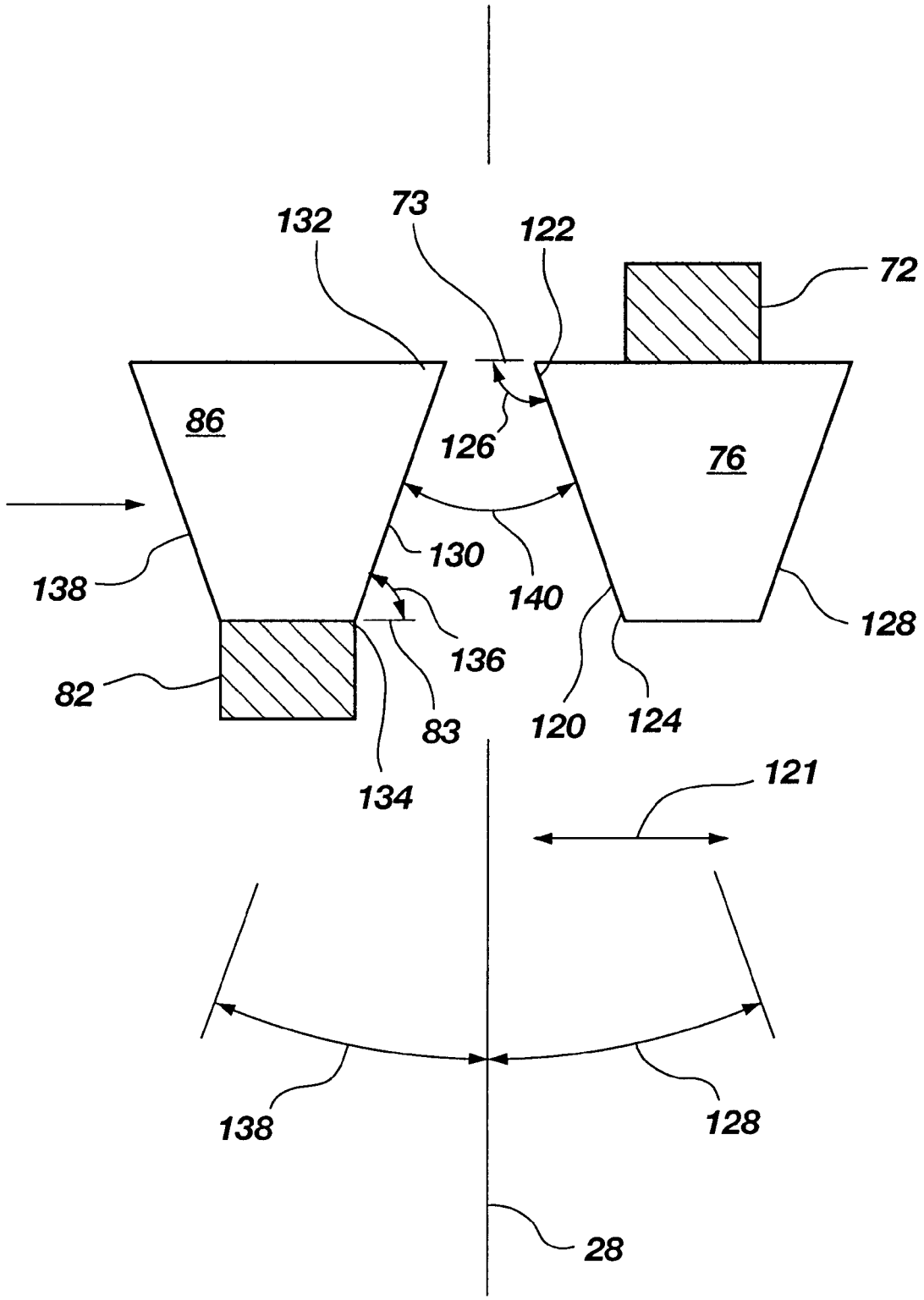
FIG. 5 is a side view of a primary stationary tooth and a secondary pivoting tooth as the teeth meet in accordance with the principles of the present invention.

Referring to FIGS. 3 and 5, the primary teeth 76 have a primary edge 120, or first primary edge. The primary edge 120 generally faces or extends towards the secondary teeth 86 as the secondary teeth approach the primary teeth 76 during rotation of the secondary cutter 43. The primary edge 120 is advantageously angled with respect to the secondary teeth 86 and angled with respect to a traverse direction 121, as shown in FIG. 5. Referring to FIG. 5, the traverse direction 121 is generally perpendicular to a radial direction in which the arms extend. Thus, the traverse direction is perpendicular to the arms, which are perpendicular to the longitudinal axis 28. The traverse direction is also parallel to a tangent of any of the radially extending arms. The traverse direction is taken with respect to any tooth. In addition, the primary edge 120 not only forms an angle with respect to the traverse direction 121, but extends in the traverse direction 121. Furthermore, the edge 120 of the teeth 76 is angled with respect to the primary plane, which is parallel with the traverse direction 121.

Referring to FIG. 5, the primary edge 120 has a leading end 122 and a trailing end 124. The leading end 122 of the primary edge 120 encounters the secondary teeth 86 first. The primary edge 120 is oriented with respect to the primary arm 72, or primary plane, to form an obtuse angle, indicated at 126. The primary edge 120 preferably forms an angle 126 with respect to the primary plane 73, or traverse direction 121, of approximately 97 degrees, or an angle 128 with respect to the longitudinal axis 28 of approximately 7 degrees. The primary edge 120 may also be a primary surface.

Referring to FIGS. 4 and 5, the secondary teeth 86 have a secondary edge 130, or first secondary edge. The secondary edge 130 generally faces or extends towards the primary teeth 76 as the secondary teeth 86 approach the primary teeth 76 during rotation of the secondary cutter 43. The secondary edge 130 is advantageously angled with respect to the primary teeth 76 and angled with respect to the traverse direction 121. In addition, the secondary edge 130 not only forms an angle with respect to the traverse direction, but extends in the traverse direction. The edge 130 of the teeth 86 is angled with respect to the secondary plane 83.

Referring to FIG. 5, the secondary edge 130 has a leading end 132 and a trailing end 134. The leading end 132 of the secondary edge 120 encounters the primary teeth 76 first. The secondary edge 130 is oriented with respect to the secondary arm 82, or secondary plane, to form an acute angle, indicated at 128. The secondary edge 130 preferably forms an angle 136 with respect to the secondary plane of approximately 83 degrees, or an angle 138 with respect to the longitudinal axis 28 of approximately 7 degrees. The secondary edge 130 may also be a secondary surface.

As shown in FIG. 5, a secondary tooth 86 approaches an adjacent primary tooth 76 as the secondary cutter 43 rotates, or during relative rotation of the two cutters. The primary and secondary teeth 76 and 86, or the primary and secondary edges 120 and 130, advantageously extend towards, or generally face towards, each other as the secondary cutter 43 rotates at an angle to each other, indicated at 140, and to the traverse direction. The primary and secondary edges 120 and 130 are preferably oriented with respect to one another to form an angle 140 of approximately 14 degrees.

The leading ends 122 and 132 of the primary and secondary teeth 76 and 86 advantageously mret first as the secondary cutter 43 rotates with respect to the primary cutter 42. Thus, force applied to the waste by the motor, and the cutters, is concentrated at a point on the teeth, rather than all along the teeth. As the cutter rotates, the force applied along a single point moves along the edge of the teeth from the leading end to the trailing end, rather than along the entire length of the teeth all at once. Thus, the force is concentrated and is better able to cut. This represents a significant improvement over prior art cutters, whose teeth are blunt and do not meet at an angle.

The secondary cutter 43 may rotate in either direction. Therefore, the primary and secondary teeth 76 and 86 have an opposite primary edge 128 and an opposite secondary edge 138, respectively. The opposite primary edge 128 is opposite the first primary edge 120. Likewise, the opposite secondary edge 138 is opposite the first secondary edge 130. The opposite edges 128 and 138 are similar to their counterpart edges 120 and 130, respectively. Thus, if the secondary cutter 43 rotates in an opposite direction, the opposite secondary edge 138 meets the opposite primary edge 128. The opposite edges 128 and 138 may be oriented at different angles than the first primary edge and first secondary edge 120 and 130.

Because the edges 120 and 130 are oriented such that they face downstream, or towards the outlet, any waste which is not cut by the teeth, but propelled away from the teeth because of the angled edges, is propelled towards the outlet and not towards the inlet, thus avoiding potential injury to a user. The edges 120 and 130, however, may be oriented to face upstream, or towards the inlet.

Although the waste disposal apparatus 10 has been described with the secondary cutter 43 pivoting with respect to the primary cutter 42, it is of course understood that either cutter may rotate with respect to the other or that both cutters may rotate.

Referring to FIG. 6, a specific illustrative embodiment of a water powered waste disposal apparatus, indicated generally at 200, is shown with a cutter apparatus, indicated generally at 210. The cutter apparatus 210 for the water powered apparatus 200 is substantially similar to the cutters 34 described above. As indicated above, the water powered apparatus 200 utilizes a protrusion 214 formed on the first arm 52 of the first cutter 41, as shown in FIG. 2, to drive or rotate the first 41, secondary 43, and fifth 45 cutters.

The apparatus 200 has an apparatus housing 218 adapted for being disposed under a sink (not shown). The housing 218 has a waste inlet 222 disposed generally at the top of the housing 218 for allowing the waste into the housing 218. The housing 218 and/or inlet 222 may be configured for being coupled to a drain (not shown) of a sink (not shown). The housing 218 also has an outlet 226 disposed generally at the bottom of the housing 218 for allowing the waste out of the housing 218. The housing 218 may have a longitudinal axis 228 extending vertically between the inlet 222 and outlet 226.

The housing 218 also defines a waste passage 230 formed in the housing 218 and extending between the waste inlet 222 and the outlet 226. The passage 230 may be concentric with the longitudinal axis 228 of the housing 218 and have a circular cross section.

A plurality of cutters 234 are disposed in the passage 230. The cutters 234 are similar in most respects to the cutters 34 shown in FIGS. 1 and 2. The first cutter 41 has a protrusion 214 formed on the first arm 52 as will be discussed in further detail below.

The water powered apparatus 200 also has a driver 240. A drive housing 242 is coupled to the apparatus housing 218 and defines an annular chamber 258 formed about the passage 230 or the longitudinal axis 228. The annular chamber 258 has a torus or donut shape and preferably has a circular cross section.

A reciprocating drive piston 274 is slidably disposed in the annular chamber 258. The drive piston 274 may move or slide within the annular chamber 258 in a rotational motion. The drive piston 274 has the same cross section as the annular chamber 58, such as circular. The drive piston 274 has a perimeter or edge which slidingly seals against the inner wall of the annular chamber 258.

The drive piston 274 is coupled to the first cutter 41. Thus, as the drive piston 274 rotates in the annular chamber 258, it drives or forces the first cutter 41 to pivot in the passage 230 of the housing 218. An annular opening 278 is formed in an inner wall of the annular chamber 258 and a wall of the passage 230 so that the opening 278 extends between the passage 230 and annular chamber 258. A dynamic annular seal is disposed in the annular opening. The drive piston 274 and the first cutter 41 couple through the annular opening 278. The protrusion 214 formed on the arm 52 of the first cutter 41 extends through the annular opening 278 and couples to the drive piston 274. It is of course understood that the drive piston may be coupled to either the primary or secondary cutters.

A control valve 300 is coupled to the drive housing 242. The control valve 300 supplies pressurized water from a source of pressurized water alternatively to opposite sides of the drive piston 274, to drive the drive piston 274 in a reciprocal manner.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A cutting apparatus comprising:

a plurality of cutters arranged in a stack having a longitudinal axis and including at least a primary cutter and a secondary cutter disposed adjacent one another in the stack with at least one of either the primary or the secondary cutter pivoting about the longitudinal axis with respect to the other cutter;

the primary cutter having a primary hub disposed at the longitudinal axis and having a plurality of primary arms extending radially therefrom;

the secondary cutter having a secondary hub disposed at the longitudinal axis and having a plurality of secondary arms extending radially therefrom;

a plurality of spaced apart primary teeth disposed on the primary arms defining primary grooves therebetween, the primary teeth extending generally towards the secondary cutter;

a plurality of spaced apart secondary teeth disposed on the secondary arms defining secondary grooves therebetween, the secondary teeth extending generally towards the primary cutter, the primary and secondary teeth intermeshing as either the primary or secondary cutter pivots with respect to the other;

at least one of the primary teeth having a primary edge and at least one of the secondary teeth having a secondary edge, the at least one of the primary teeth being disposed on the primary cutter and the at least one of the secondary teeth being disposed on the secondary cutter such that the primary and secondary edges pass adjacent one another as either the primary or secondary cutter pivots with respect to the other, the primary and secondary edges being angled towards one another in the direction of rotation such that the primary and secondary edges concentrate force at a single point along the edges as the edges pass one another.

2. The apparatus of claim 1, wherein the primary edge is oriented at an obtuse angle with respect to the primary arm.

3. The apparatus of claim 1, wherein the secondary edge is oriented at an acute angle with respect to the secondary arm.

4. The apparatus of claim 1, wherein the primary and secondary edges are oriented to form an angle therebetween of approximately 14 degrees.

5. The apparatus of claim 1, wherein the at least one primary tooth has an opposite edge opposite the primary edge, and wherein the at least one secondary tooth has an opposite secondary edge opposite the secondary edge, each opposite edge extending at an angle to the traverse direction.

6. The apparatus of claim 1, further comprising a housing having an inlet, an outlet, and a passage extending therebetween, the primary cutter and the secondary cutter being disposed in the passage and oriented with the longitudinal axis generally parallel with the passage.

7. The apparatus of claim 1, wherein the primary edge of the at least one primary tooth and the secondary edge of the at least one secondary tooth each have leading ends and tailing ends such that the leading ends of the primary and secondary edges encounter each other before the tailing ends.

8. The apparatus of claim 1, wherein the at least one primary tooth and the at least one secondary tooth each have a profile in a radial direction, the profile of the at least one primary tooth narrowing from the primary cutter towards the secondary cutter, and the profile of the at least one secondary tooth widening from the secondary cutter towards the primary cutter.

9. The apparatus of claim 1, wherein the primary and secondary edges are oriented to generally face towards a downstream direction.

10. A waste disposal apparatus, comprising:

a housing having a waste inlet, an outlet, and a passage extending therebetween, the passage having a longitudinal axis;

a plurality of cutters disposed in the passage of the housing for cutting the waste and including at least one pivoting cutter pivotally disposed in the passage and at least one stationary cutter fixedly disposed in the passage adjacent the pivoting cutter;

drive means for rotating the at least one pivoting cutter;

the stationary cutter having a stationary hub disposed at the longitudinal axis and having a plurality of stationary arms extending radially therefrom;

the pivoting cutter having a pivoting hub disposed at the longitudinal axis and having a plurality of pivoting arms extending radially therefrom;

a plurality of spaced apart stationary teeth disposed on the stationary arms defining stationary grooves therebetween, the stationary teeth extending generally towards the pivoting cutter;

a plurality of spaced apart pivoting teeth disposed on the pivoting arms defining pivoting grooves therebetween, the pivoting teeth extending generally towards the stationary cutter, the stationary and pivoting teeth intermeshing as the pivoting cutter pivots with respect to the stationary cutter;

at least one of the stationary teeth having a stationary edge and at least one of the pivoting teeth having a pivoting edge, the at least one of the stationary teeth being disposed on the stationary cutter and the at least one of the pivoting teeth being disposed on the pivoting cutter such that the stationary and pivoting edges pass adjacent one another as the pivoting cutter pivots, the stationary and pivoting edges being angled towards one another in the direction of rotation such that the pivoting and stationary edges concentrate force at a single point along the edges as the edges pass one another.

11. The apparatus of claim 10, wherein the stationary edge is oriented at an obtuse angle with respect to the stationary arm.

12. The apparatus of claim 10, wherein the pivoting edge is oriented at an acute angle with respect to the pivoting arm.

13. The apparatus of claim 10, wherein the stationary and pivoting edges are oriented to form an angle therebetween of approximately 14 degrees.

14. The apparatus of claim 10, wherein the at least one stationary tooth has an opposite stationary edge opposite the stationary edge, and wherein the at least one pivoting tooth has an opposite pivoting edge opposite the pivoting edge, each opposite edge extending at an angle to the traverse direction.

15. The apparatus of claim 10, wherein the drive means is an electric motor.

16. The apparatus of claim 10, wherein the drive means is a hydraulic motor.

17. The apparatus of claim 10, wherein the drive means comprises a housing having an annular chamber and a reciprocal drive piston slidably disposed in the annular chamber and coupled to at least one of the primary or secondary cutters.

18. The apparatus of claim 10, wherein the primary and secondary edges generally face towards the outlet such that waste in propelled towards the outlet.

* * * * *